United States Patent [19]

Minialoff et al.

[11] Patent Number: 4,637,190

[45] Date of Patent: Jan. 20, 1987

[54] BUILDING PANEL

[76] Inventors: Gerrard O. Minialoff; Martin J. Minialoff; Andrew J. Minialoff, all of Box 107, R.R. #1, Kleinberg, Ontario, Canada, L0J 1C0

[21] Appl. No.: 630,137

[22] Filed: Jul. 12, 1984

[30] Foreign Application Priority Data

Jul. 15, 1983 [CA] Canada ..... 432513

[51] Int. Cl.[4] ..... E04C 1/10

[52] U.S. Cl. ..... 52/579; 52/588; 52/732

[58] Field of Search ..... 52/404, 406, 432, 479, 52/482, 576, 732, 588, 593, 594, 595, 579, 578, 782

[56] References Cited

U.S. PATENT DOCUMENTS

| | | | |
|---|---|---|---|
| 1,988,314 | 1/1935 | Higley | 52/630 X |
| 2,026,278 | 12/1935 | Higley | 52/579 |
| 2,424,080 | 7/1947 | Engstrom | 52/579 |
| 2,762,472 | 9/1956 | Jackson | 52/579 |
| 3,531,902 | 10/1970 | DaCosta | 52/588 |
| 3,834,105 | 9/1974 | Powers | 52/732 X |
| 4,461,134 | 7/1984 | Lowe | 52/732 |

FOREIGN PATENT DOCUMENTS

| | | | |
|---|---|---|---|
| 1683307 | 9/1970 | Fed. Rep. of Germany | 52/588 |

*Primary Examiner*—William F. Pate, III
*Assistant Examiner*—Creighton Smith
*Attorney, Agent, or Firm*—Rogers, Bereskin & Parr

[57] ABSTRACT

A building panel is formed from a single sheet of material, and comprises an inner panel portion, a web portion, and an outer panel portion. The web portion extends between the inner and outer panel portions. In use, the panels are arranged with adjacent inner and outer panel portions overlying one another. Consequently, an outer wall surface can be formed from the outer panel portions, while an inner wall surface is formed from the inner panel portions. To insulate the wall, insulation can be provided between the inner and outer panel portions.

10 Claims, 3 Drawing Figures

BUILDING PANEL

This invention relates to a building panel. This invention more particularly relates to a building panel, suitable for walls and roofs, which are formed from inner and outer steel sheets or panels with insulation between them.

Steel and other metal panels are commonly used for cladding the exteriors of buildings. One known construction technique uses separate interior and exterior panels. This permits a layer of insulation to be provided between the interior and exterior panels. After the basic structural steel skeleton has been put up, the liner or interior panels are secured to the structural steel. Then, insulation is applied to the liner panels. For the exterior panels, sub-girts, which are typically of Z-section, have then to be secured to the liner panels and via the liner panels to the structural steel frame. Finally, the exterior panels can be secured to these sub-girts.

Such an assembly technique, whilst producing an acceptable cladding, is relatively complicated, and consequently requires a large amount of labor. Also, care has to be taken to ensure that all the various elements fit together properly, and that the finished cladding is weather proof.

Another known type of wall and roof system utilizes insulated combination panels. Each panel is a combination of an exterior panel and an interior panel, which are bounded together by a thick layer of foam between them. The foam serves both a structural function and as insulation. After on site assembly of the steel frame or skeleton, assembly of a wall or roof is quicker and simpler, since each panel provides the functions of the numerous different components used in other constructions. However, the equipment needed for the manufacture of these combination panels is complex and requires a large capital outlay.

According to the present invention, there is provided a building panel formed from a single sheet of material and comprising:

an outer panel portion, which is generally planar and includes a first coupling channel extending adjacent a free edge of the outer panel portion with a second coupling channel extending parallel to the first coupling channel adjacent an opposite edge of the outer panel portion, which first and second coupling channels have complementary shallow, trapezoidal cross-sections, to enable a first coupling channel to fit whithin a second coupling channel;

an inner panel portion, adapted to be overliad by an outer panel portion, which inner panel portion is generally planar and includes a third coupling channel along a free edge portion of the inner panel portion; and a web portion extending between the inner and outer panel portions and including a fourth coupling channel extending parallel to the third coupling channel adjacent an opposite edge of the inner panel portion, the third and fourth coupling channels, having complementary shallow, trapezoidal cross-sections, to enable a fourth coupling channel to fit within a third coupling channel, whereby, in use, a surface of a building can be formed from a plurality of said panels disposed adjacent one another with adjacent inner and outer panel portions overlying one another and with the coupling channels engaging one another.

Preferably, the web portion is so dimensioned as to space the inner and outer panels or panel portions from one another in a direction normal to the plane of the cladding or wall, sufficiently to permit insulation to be placed between the inner and outer panel portions. The panel of the present invention provides in one unit the inner panel, the outer panel and the subgirts of known systems.

For example, after assembly of the steel frame, a side of a building can be clad quickly and simply. If required, a separate inner panel portion of a panel defined above can be separated from the exterior panel portion and secured to the frame. The web portion can either be left attached to one of the inner and exterior panel portions, or it can be disposed of. The inner panel portion is then secured adjacent one edge of the side of the building. Insulation is placed on this inner panel portion and secured in position. A complete panel is secured in position adjacent to the already present inner panel portion. The inner panel portion of this next panel is secured to the structural steel, and the exterior or outer panel portion is placed over the insulation and secured to the already present inner panel portion. A second strip of insulation can then be located on the inner panel portion of this first complete panel. This cycle can be completed across the width or depth of the building, depending on the orientation of the panels, until the entire side of the building is covered.

Thus, in effect, as each panel is laid, it simultaneously provides an outer panel portion for one part of the surface, an inner panel portion for another part of the surface, and, in effect, a subgirt which would have to be provided separately in a known construction. If required to finish the surface, an exterior panel portion can be separated from a panel and secured adjacent another edge of the side of the building.

The panel of the present invention can be applied to any part of a building, including both walls and roof surfaces.

In the case of surfaces which require two or more rows of panels, it is convenient if all the rows of panels are laid simultaneously. Thus, one would first secure an appropriate number of inner panel portions to one edge of the surface, with the inner panel portions disposed end to end, and overlapping one another as required. After applying insulation, an equivalent number of panels would be secured end to end in position covering these inner panel portions, and so on across the surface.

The insulation used can be any known insulation, such as fiberglass, or mineral fiber. Foam insulation can be used, and in this case it is conveniently applied by injection after the panels have been secured in position.

Various configurations can be used for the web portion. Preferably, it is designed to minimize thermal loss, and for this purpose it should have as low a thermal conductivity as possible. The web portion can be provided with large cut outs leaving short limb portions extending between the inner and outer panel portions. The limb portions can either extend normal to the inner and outer panel portions, or at an angle thereto. Alternatively, or as well, the web portion can be corrugated. The length of the limb portions can be varied, and amongst other things will be determined by the overall depth of the web portion and the orientation of the limb portions. To strenthen the limb portions and increase their buckling resistance they can be provided with folded edges.

The use of a continuous web portion with no openings has the advantage that in the finished cladding there is no direct passage for air or moisture. Air or moisture can only travel between the interior and exterior by passing through the joint between two panels and then diagonally across the space between these two panels and then between the other joint between these two panels. This provides for secure weatherproofing, as faults have to develop in both joints before moisture can travel between the inside and the outside of the structure.

For a better understanding of the present invention and to show more clearly how it may be carried into effect, reference will now be made, by example, to the accompanying drawings which show an embodiment of the present invention and in which:

FIG. 4 shows a perspective view, corresponding to FIG. 1 of a further embodiment of the present invention.

Figure 1:
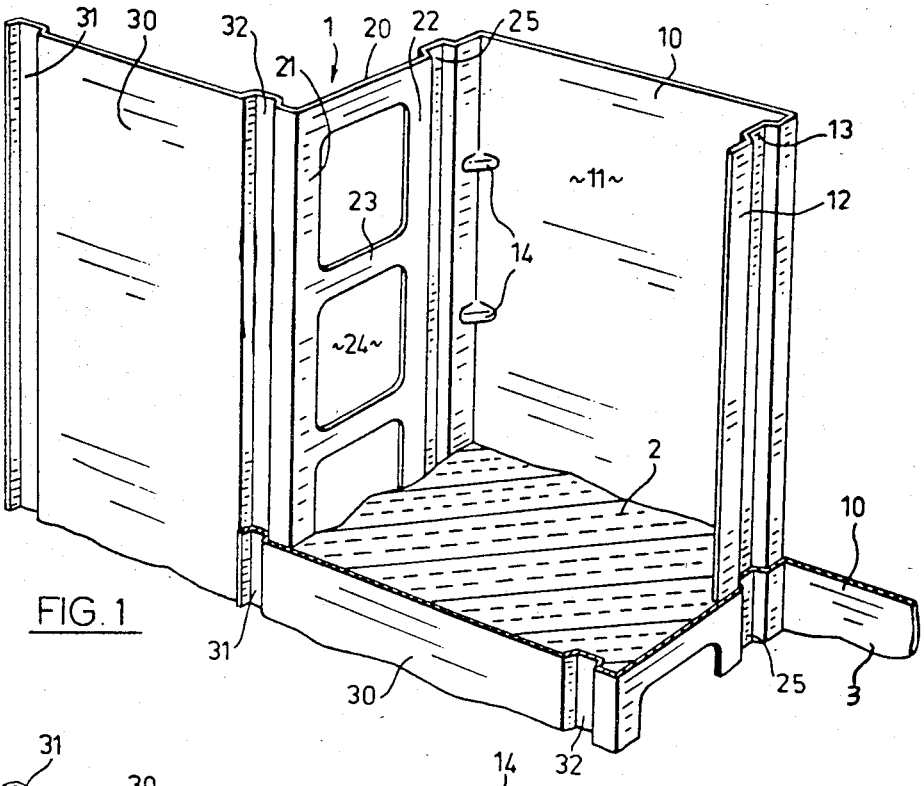
FIG. 1 shows a perspective view of part of a cladding formed from a panel according to the present invention, in section.

With reference to FIG. 1, there is shown a cross-section through one panel 1 according to the present invention, and part of a cross-section through a second panel 3. Since all the panels are similar, the details of each panel will be described with particular reference to panel 1.

The panel 1 has an inner panel portion 10, a web portion 20 and an exterior panel portion 30, which are continuous with one another. The inner panel portion 10 comprises a main rectangular sheet 11. A free edge strip 12 of the inner panel portion 10 is continuous with the rectangular sheet 11 and is perpendicular to it. For coupling purposes, a channel 13 is provided in the edge strip 12. The channel 13 is of generally trapezoidal cross-section.

The web portion 20 comprises edge strips 21 and 22, and extending between the edge strips 21, 22 cross pieces 23. Consequently, apertures 24 are defined between the edge strips 21 and 22 and the cross-pieces 23. In the edge strip 22, which is continuous with the rectangular sheet 11, a channel 25 is provided for coupling purposes. Again, this channel 25 is of generally trapezoidal cross-section. To reinforce the panel 1, gussets 14 are provided between the inner panel portion 10 and the web portion The outer panel portion 30 essentially comprises a single rectangular sheet. Along two opposite edges of the outer portion, there are provided channels 31 and 32, for coupling purposes. The channel 31 is located immediately adjacent the left-hand edge of the outer panel portion 30 as viewed in FIG. 1. The channel 32 is located adjacent the web portion 20. Again, both these channels 31 and 32 are of generally trapezoidal cross-section.

The channels 31 and 32 are complementary to one another, and comprise respective first and second coupling formations. The channel 32 is slightly larger than the channel 31, to allow for the thickness of the material. Similarly, the channels 13 and 25 comprise complementary third and fourth coupling formations, and the channel 13 is slightly larger than the channel 25.

The dimensions of the panel 1 can be chosen to suit any particular design requirement. Typically, the panel could have varying widths dependent on architectural and design requirements. The width could be in the range 0.5–1 meters. It could be of any length that is feasible to transport. The main profile of the panel 1 is formed by brake folding or forming or roll forming from sheet metal, and then the gussets 14 are formed by stamping, together with any other gussets or like reinforcements. If required, gussets can be provided between the web portion 20 and the outer panel portion 30. The panel can be formed from aluminum, galvanized or aluminumized steel or stainless steel or other metal. Further, it can be given any desired coating in a variety of colours.

Figure 3:
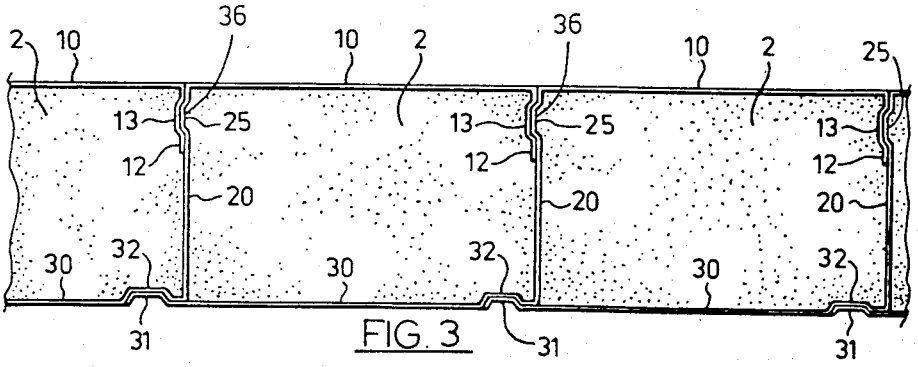
FIG. 3 shows a cross-section through a cladding formed from panels according to the present invention.

As shown in FIG. 1 and FIG. 3, in a cladding formed from panels according to the present invention, the panels co-operate to form a continuous interior surface vapour barrier and a continuous exterior surface or weatherseal. To form the vapour barrier and weatherseal, a suitable sealant can be provided between both the inner panel portions 10 and the outer panel portions 30.

As shown in FIG. 1, there is a panel 3 which is similar to the panel 1, and like parts of the second panel 3 are given the same reference numeral. The channels 31 and 25 of the panel 3 engage the corresponding channels 32 and 13 of the panel 1. To secure the panels in position, the inner panel portion 10 can be secured to a frame (not shown) by means of screws at desired locations. The individual panels can be secured to one another by screws securing the complimentary sections together. For this purpose, the channels 13, 25, 31 and 32 can be pre-formed with appropriate openings. Then, screws can be screwed through the channels 25 and 31 of the panel 3 into the channels 13 and 32 of the panel 1, leaving the screw heads in the channels 25, 31. For insulation purposes, known insulation material, such as fibreglass or mineral fibre, can be provided in the spaces formed between adjacent panels, as indicated at 2 in FIG. 1.

To form a complete surface of a structure, the supporting steel framework is first assembled. Then, generally it is necessary to separate the inner panel portion 10 of one panel from the remainder of that panel. Conveniently, the inner panel portion 10 and the web portion 20 are separated together from the corresponding outer panel portion. This inner panel portion 10 can then be secured along one edge of the surface, with the web portion 20 along the edge itself. The inner panel portion 10 is. screwed or otherwise secured to the frame at appropriate intervals. Insulation material 2 is laid against the inner panel portion 10 and secured in position. One can then place a complete panel 1 in position. It is placed in position with its outer panel portion 30 overlying the already positioned inner panel portion 10, so as to enclose the insulation material 2. Its inner panel portion 10 is secured to the frame by screws, and screws can be used to secure its channel 25 to the channel 13 of the previously laid separate inner panel portion 10. Since there is no previously laid exterior panel portion 30, its exterior panel portion 30 is secured by a special corner piece. The special corner piece is provided for providing continuity between the surface under construction and an adjacent surface. The channel 31 of this first complete panel can be screwed to this corner piece. After laying of this first complete panel another strip of insulation material is positioned and secured against its inner panel portion 10. Then, another complete panel can be laid. For this second and subsequent complete panels, both the channels 25 and 31 can be secured by screws to the corresponding channels 13 and 32 of the previously laid panel. This sequence can be repeated across the width of the surface, until a final complete panel is laid. The last complete panel will have its inner panel portion 10 adjacent an opposite edge of the surface. Again, insulation will be laid and secured against this inner portion 10. However, it will then be necessary to separate an outer panel portion 30 with its associated web portion 20 from the inner panel portion 10 of the panel. This separate outer panel portion 30 and web portion 20 unit can then be secured in position covering the final layer of insulation. It can be secured by means of screws and its channels 31 and 25. Again, a special corner piece or an end piece can be used to finish the surface.

The preceding paragraph has described the assembly procedure for a surface whose height corresponds to the length of the panels. In cases, where it is necessary to use two or more rows of panels to cover the entire surface, it is preferable that the rows of panels are laid simultaneously. Thus, for a two row surface, one would first position two separate inner panel portions 10 on the frame. Then, after laying appropriate insulation, two complete panels would be laid and secured, overlapping one another with their outer panel portions 30 covering the previously laid insulation. This procedure could then be continued across the full width of the surface.

To ensure good sealing between abutting panels 1, a sealing compound can be applied between abutting coupling channels 13, 25 and also 31, 32. This is indicated at 36 in FIG. 3.

Whilst the above described assembly technique requires the provision of separate inner and outer panel portions, this need not always be necessary. In particular, for the sides of a building special corner pieces could be provided that provide an inner panel portion on one side of the building and an outer panel portion on another side of the building.

Figure 2:
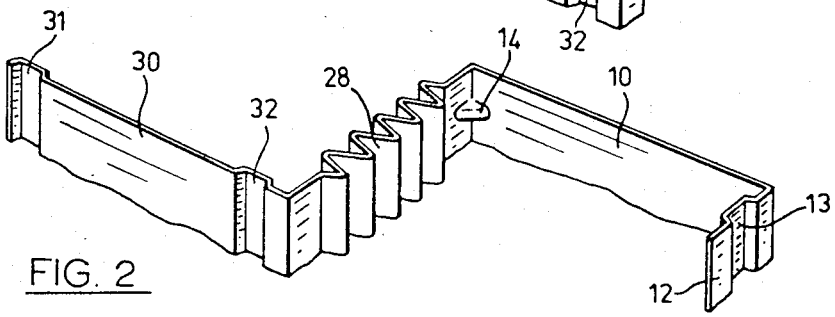
FIG. 2 shows a perspective view of a cross-section through an alternative embodiment of a panel according to the present invention.

As described above, the web portion 20 is provided with cross-pieces 23, separating apertures 24 from one another. The purpose of this construction is to increase the thermal resistance of the panel construction, in order to reduce heat transfer between the interior and the exterior of the building. For this purpose, various alternative designs of the web portion 20 could be used, and FIG. 2 shows one alternative. Here, the web portion 20 is corrugated as indicated at 28. These corrugations 28 serve to increase the thermal path between the interior and the exterior, and hence to increase the thermal resistance. The corrugations 28 could be combined with apertures as shown in FIG. 1, to further increase the thermal resistance.

FIG. 4 shows a further embodiment, in which like parts are given the same reference numerals as in FIG. 1. Here, diagonal cross pieces 38 are provided to form triangular apertures 40.

We claim:

1. A building panel formed from a single sheet of material and comprising:

an outer panel portion, which is generally planar and includes a first coupling channel extending adjacent a free edge of the outer panel portion with a second coupling channel extending parallel to the first coupling channel adjacent an opposite edge of the outer panel portion, which first and second coupling channels have complementary shallow, trapezoidal cross-sections, to enable a first coupling channel to fit within a second coupling channel;

an inner panel portion, adapted to be overlaid by an outer panel portion, which inner panel portion is generally planar and includes a third coupling channel; and a web portion extending between the inner and outer panel portions and including a fourth coupling channel extending parallel to the third coupling channel adjacent an opposite edge of the inner panel portion, the third and fourth coupling channels having complementary shallow, trapezoidal cross-sections, to enable a fourth coupling channel to fit within a third coupling channel, whereby, in use, a surface of a building can be formed from a plurality of said panels disposed adjacent one another with adjacent inner and outer panel portions overlying one another and with the coupling channels engaging one another.

2. A panel as claimed in claim 1, wherein the web portion is provided with a plurality of apertures separated by cross pieces extending across the web portion.

3. A panel as claimed in claim 2, wherein the cross pieces extend transverely across the web portion.

4. A panel as claimed in claim 2, wherein the cross pieces extend diagonally across the web portion.

5. A panel as claimed in claim 1, 2 or 3, wherein the web portion has a corrugated cross-section, to reduce its thermal conductivity.

6. A panel as claimed in claim 1, wherein gussets are provided between the outer panel portion and the web portion, and between the web portion and the inner panel portion.

7. A cladding of a structure comprising a plurality of panels as claimed in claim 1, wherein an inner panel portion of one panel is separated from the remainder of that panel and is provided as a separate inner panel portion along one edge of a surface; an outer panel portion of a second panel is separated from the remainder of that panel and is provided as a separate outer panel portion along a second edge, opposite the first edge of the surface; and a plurality of panels are disposed in a row between the first and second edges of the surface, with their inner and outer panel portions overlapping one another, with the outer panel portion of a panel adjacent to the first edge overlapping said separate inner panel portion and with the inner panel portion of the panel adjacent to the second edge of the surface disposed beneath said separate outer panel portion.

8. A cladding as claimed in claim 7, wherein insulation material is provided between the inner and outer panel portions.

9. A cladding as claimed in claim 7 or 8, wherein a sealing compound is provided between abutting surfaces of the inner panel portions to form an inner vapour barrier, and between the outer panel portions to form an exterior weather seal.

10. A building panel as claimed in claim 1, wherein the second coupling channel is formed along an edge of the outer panel portion.

* * * * *